US005718612A

United States Patent [19]

Elsholz

[11] Patent Number: 5,718,612

[45] Date of Patent: Feb. 17, 1998

[54] PERSONAL WATERCRAFT SHELTER

[76] Inventor: John F. Elsholz, 14721 Cottonwood Ct. SE., Mill Creek, Wash. 98012

[21] Appl. No.: 719,584

[22] Filed: Sep. 25, 1996

Related U.S. Application Data

[63] Continuation-in-part of Ser. No. 490,730, Jun. 15, 1995, abandoned.

[51] Int. Cl.[6] ..... B63B 35/58

[52] U.S. Cl. ..... 441/38; 441/129; 441/87; 114/351; 114/361

[58] Field of Search ..... 441/131, 38, 129, 441/87; 114/343, 345, 346, 351, 361

[56] References Cited

U.S. PATENT DOCUMENTS

| | | | |
|---|---|---|---|
| 2,998,613 | 9/1961 | Lynn et al. | 441/131 |
| 3,871,042 | 3/1975 | Farmer . | |
| 3,936,969 | 2/1976 | Richard . | |
| 4,619,620 | 10/1986 | Felter | 441/131 |
| 4,671,203 | 6/1987 | Sanburg | 114/361 |
| 4,766,918 | 8/1988 | Oedkirk . | |
| 4,979,456 | 12/1990 | Steward | 114/361 |
| 5,070,807 | 12/1991 | Lewis . | |
| 5,394,822 | 3/1995 | Worland | 114/361 |

OTHER PUBLICATIONS

Wood River Catalog (date of catalog unknown but believed to be prior to Jun. 15, 1995).

*Primary Examiner*—Stephen Avila

*Attorney, Agent, or Firm*—Graham & James LLP/Riddell Williams PS

[57] ABSTRACT

A portable shelter (10) provides protection for users (18) of an individual float tube (12) or a pontoon style kick board (76). The shelter (10) comprises a covering 32 having transparent front panels (39), transparent side and rear panels (34,37), and translucent or opaque lower front panels (36*a*), side panels (36*c*) and rear panels (36*b*). A flexible longitudinal rod (38) and transverse rod (40) maintain the dome-like configuration of the shelter (10). It is easily mounted on the top surface (22) of the tube (12) by using the straps (60) and side straps (53) and by inserting the transverse rod (40) into side pockets (58) that are in turn inserted between the handles (14) and the tube (12). A rear strap (50) and side straps (60) further secure the shelter (10) to the tube (12). The front flaps (39) open to provide access for fishing, hunting, photography, and the like, or they may be zipped shut for protection from the elements and greater concealment.

5 Claims, 9 Drawing Sheets

PERSONAL WATERCRAFT SHELTER

This application is a continuation-in-part of application Ser. No. 08/490,730 filed Jun. 15, 1995, abandoned.

TECHNICAL FIELD

The present invention pertains to coverings or shelters for personal watercraft, and, more particularly, to a portable shelter for individual float tubes, kick boats, and the like.

BACKGROUND OF THE INVENTION

There are several forms of light watercraft that are utilized by outdoor recreationalists. These craft enable the user to fish, hunt, photograph wildlife, and to enjoy the outdoors in a unique manner. Such craft can be used to stealthily approach wildlife, such as fish and ducks, and to reach areas that may otherwise be inaccessible by boats. Moreover, being partially submerged in the water, such as with waders and fins, heightens the outdoor enthusiast's sense of adventure, and thus his outdoor experience.

There are currently two general classes of devices that comprise these watercraft, though this invention is applicable to all forms of light watercraft. The first is referred to generally as float tubes, and they come in various sizes and shapes. For example, some are donut shaped, while others are shaped like a "U," which are sometimes referred to as "U-boats." The second class is referred to as "kick boats," and they are generally constructed of parallel pontoons which have rigid metal and/or plastic frames mounted on them which supports a seat between the pontoons. The distinguishing features of these two classes of watercraft from boats are their accommodation for only one person, floatation is provided by one or more inflatable bladders or sealed air cells, the occupant generally wears waders and swim fins, and propulsion of the watercraft is usually achieved by a combination of kicking with the swim fins and rowing with oars (though fins or oars alone can be sufficient). Finally, these watercraft are typically light enough for portability by one person.

A common problem for all users of watercraft is protection from cold and wet weather. Manufacturers have tried to solve this problem by producing an exhaustive list of clothing items, including hats, coats, and special gloves that impart warmth and protection for the user from rain, snow, sleet, hail, etc. This clothing may protect the user to some degree, but everything else in the watercraft, such as food, cameras, and other equipment is exposed to the elements.

Hence, there is a need for a device that can be quickly assembled and attached to the watercraft that protects the user and the contents of the watercraft from the elements. Such a device must be storable in a compact space, sufficiently light weight to enable backpacking, durable, quickly and easily assembled, and must not interfere with the occupant's activity or enjoyment of the environment.

SUMMARY OF THE INVENTION

The present invention is directed to a shelter for single-user watercraft, such as float tubes, kick boats, and the like, the watercraft having structural members, including at least one flotation member, such as an inflatable tube or a pair of pontoons held in spaced parallel relationship by transverse structural members. The shelter comprises a flexible coveting, shape retaining members for holding the flexible covering in a taut condition, and attaching devices for attaching the covering to the watercraft.

In accordance with another embodiment of the present invention, a tensioning device is included for tensioning the covering on the watercraft to thereby urge the covering above the watercraft. Ideally, the tensioning device comprises a flexible filament having one end attached to the watercraft and the other end attached to the covering.

In accordance with another aspect of the present invention, the tensioning device further includes an adjusting mechanism for adjusting the amount of tension applied by the flexible filament to the covering. Alternatively, or in combination therewith, the flexible filament is formed of elastic material.

In accordance with a further aspect of the present invention, a shelter is provided that comprises a covering formed of flexible material and having an enclosed top and an open bottom; shape retaining members for holding the covering in a taut condition, the shape retaining members further comprising at least one transverse member and at least one longitudinal member, each of the shape retaining members having an elongate configuration with a first end and a second end and being formed from resilient material; engagement devices for engaging the shape retaining members with the covering such that the second end of the longitudinal member is positioned at least adjacent to the top of the covering; and attaching devices for releasably attaching the covering to the watercraft.

In accordance with another aspect of the present invention, a tensioning device for tensioning the cover on the watercraft is provided to thereby urge the cover above or away from the watercraft. Ideally, the tensioning device has one end functionally attached to the first end of the longitudinal member and other end attached to the watercraft to urge the longitudinal member away from the watercraft.

In accordance with yet another aspect of the present invention, the tensioning device further comprises an adjusting mechanism for adjusting the applied length of the flexible filament to thereby provide adjustment in the tension exerted on the longitudinal member. Alternatively or in combination therewith, the flexible filament is formed of elastic material.

In accordance with still yet a further aspect of the present invention, a shelter is provided comprising a taut covering having an enclosed top and an open bottom sized and shaped to be received on the watercraft, the taut covering formed of flexible material and held in the taut condition by shape retaining members engaged therewith; the shape retaining members comprising at least one longitudinal member and one transverse member, each of the shape retaining members having an elongate configuration with a first end and a second end, and the shape retaining members being formed of a resilient material; the longitudinal member having a second end positioned at least adjacent to the top of the covering and the first end engaged with the bottom of the covering; and attaching devices for removably attaching the taut covering to the watercraft.

In accordance with another aspect of the present invention, the shelter further includes at least one device for urging the second end of the longitudinal member away from the watercraft. Ideally, a flexible filament is used, having one end attached to the first end of the longitudinal member and the other end attached to the watercraft whereby the longitudinal member is braced against the watercraft to thereby urge the second end of the longitudinal member away from the watercraft.

As will be readily appreciated from the foregoing description, the present invention provides a unique covering or shelter for single-user watercraft that can be broken down and easily stored as well as quickly deployed and attached to the watercraft. It is lightweight and compact, facilitating its use for backpacking and portage. The covering is further tensioned with respect to the watercraft to hold it above the head of a user, even during flexing of the watercraft. Thus, structural integrity is maintained despite minor changes in the condition and shape of the watercraft. Such a shelter provides protection not only from the elements, but also enhances concealment and provides means for storing equipment when in use.

BRIEF DESCRIPTION OF THE DRAWINGS

The foregoing and other features and advantages of the present invention will become better understood from the detailed description when taken in conjunction with the following drawings, wherein.

DETAILED DESCRIPTION

Figure 1:
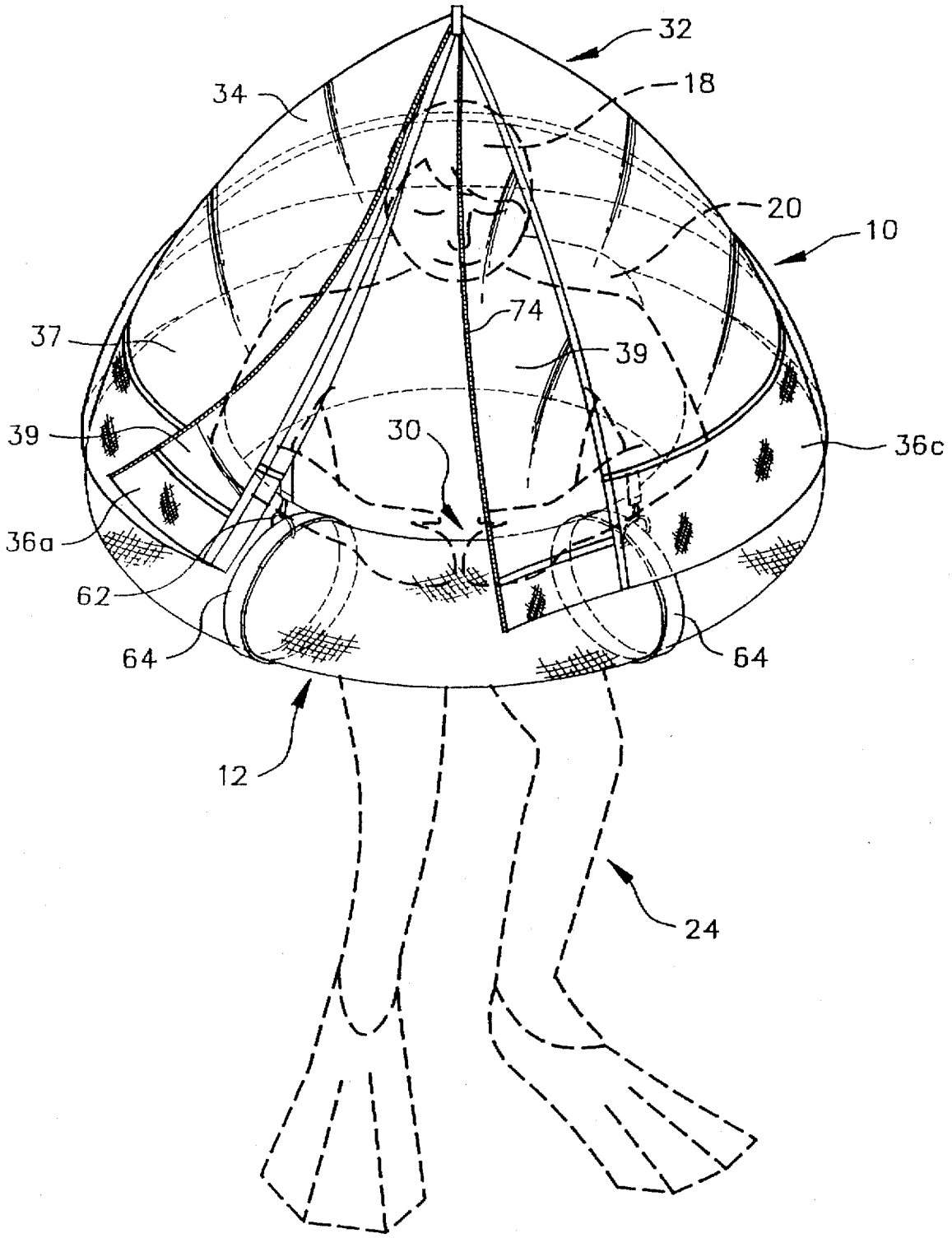
FIG. 1 is an isometric projection of the shelter formed in accordance with the present invention as mounted on a float tube.
Figure 2:
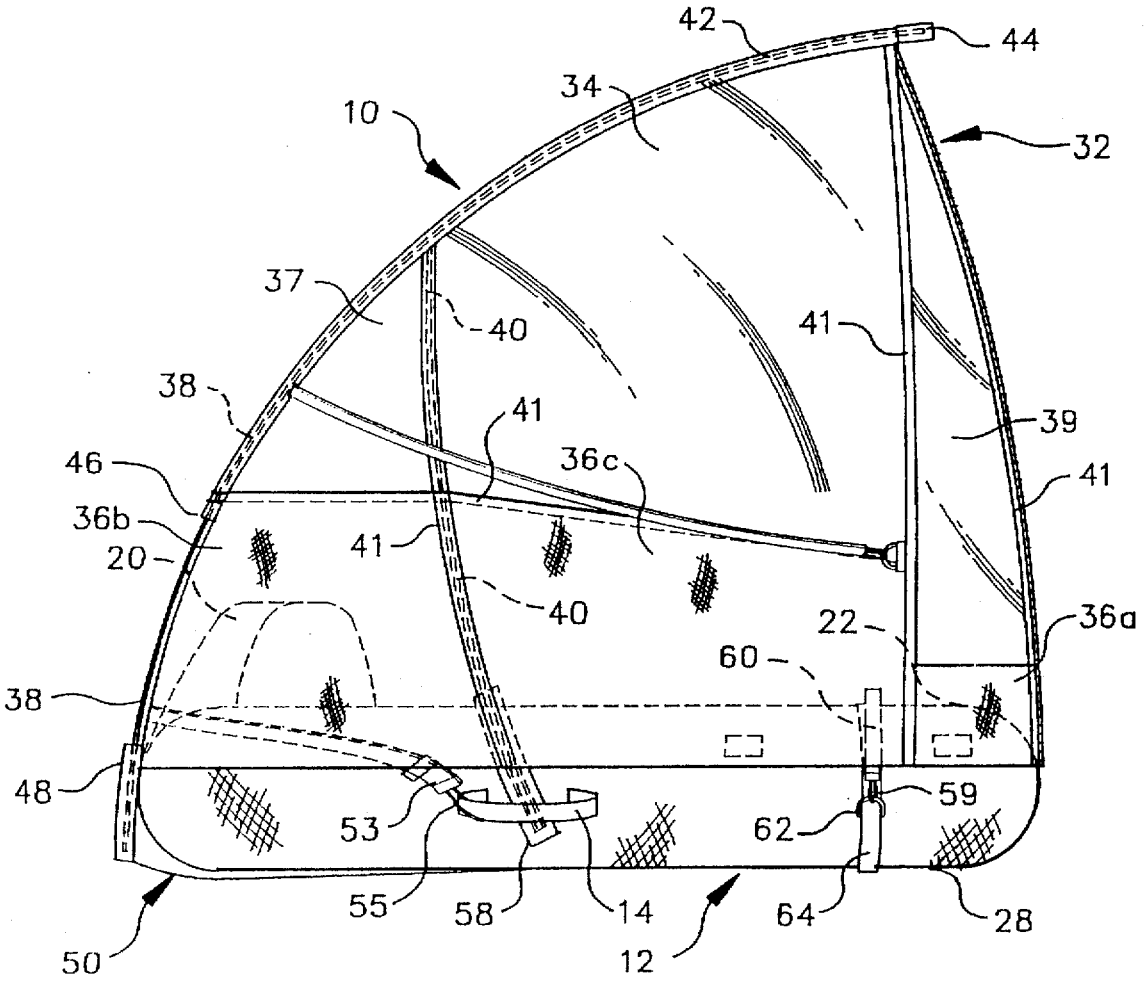
FIG. 2 is a side plan view of the shelter of FIG. 1.
Figure 3:
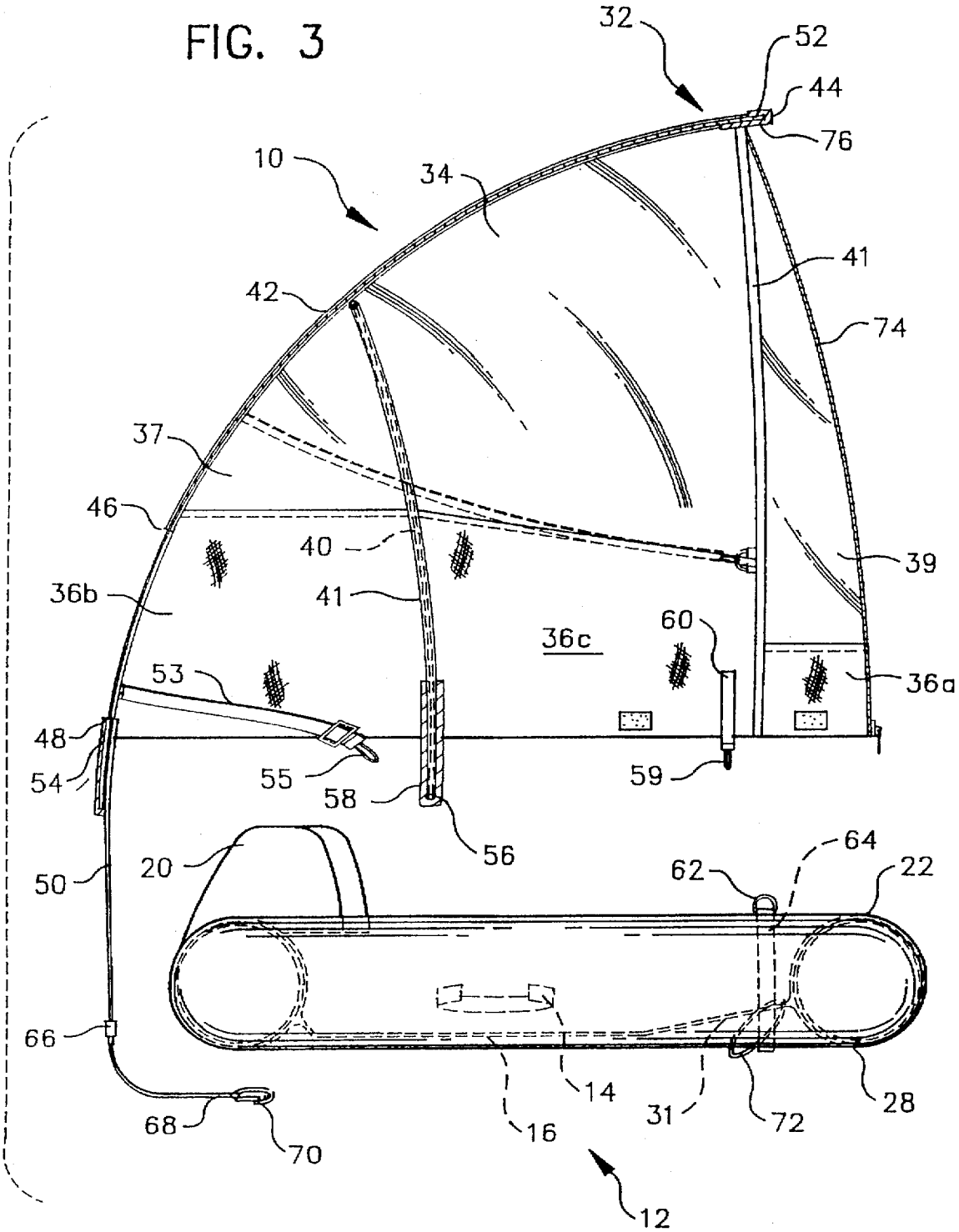
FIG. 3 is an exploded side plan view in partial cross section of the shelter of FIG. 2.
Figure 4:
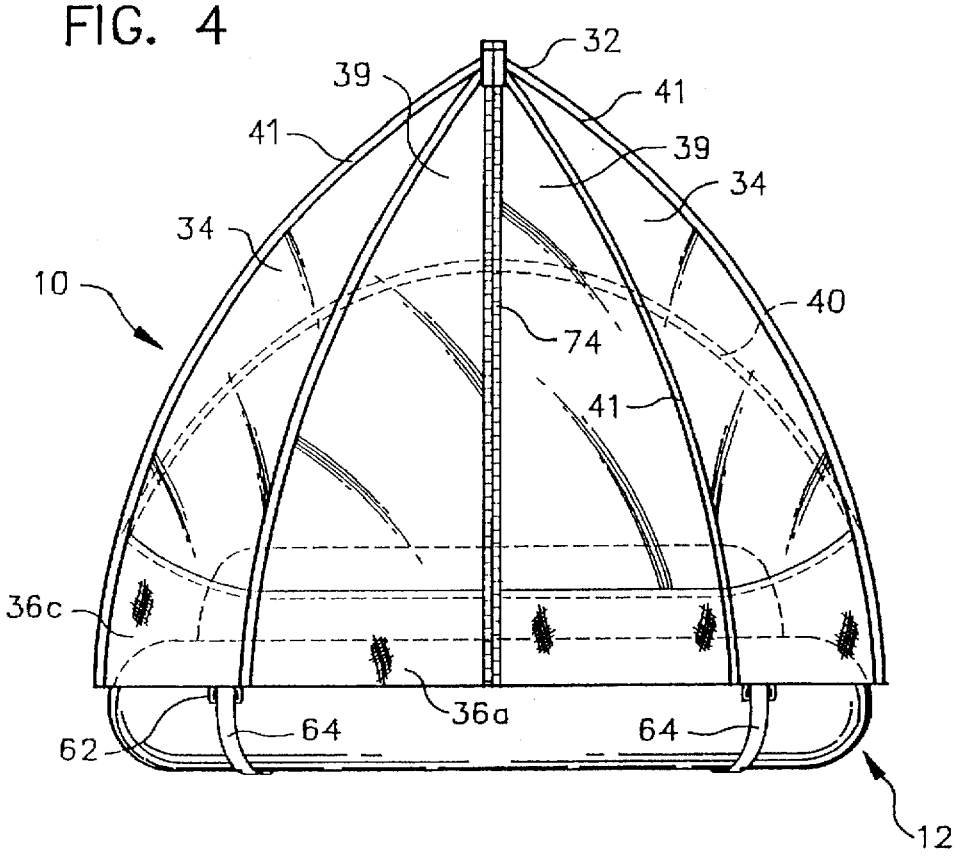
FIG. 4 is a front plan view of the shelter of FIG. 1.

A representative embodiment of the present invention will be illustrated and described, with reference being made to FIGS. 1–5. A shelter 10 formed in accordance with the present invention is shown in association with a float tube 12. The tube 12 is donut-shaped, but other types of floatable tubes and boats can be used. The tube 12 includes handles 14 for carrying and a seat 16 (shown in FIGS. 3 and 5) for a user 18 (shown in FIG. 1). An optional back support 20 that functions as one or more storage sacks or pockets for additional air bladders, is formed on the top surface 22 of the tube 12 and positioned to be behind the back of the user 18 when seated therein.

Figure 5:
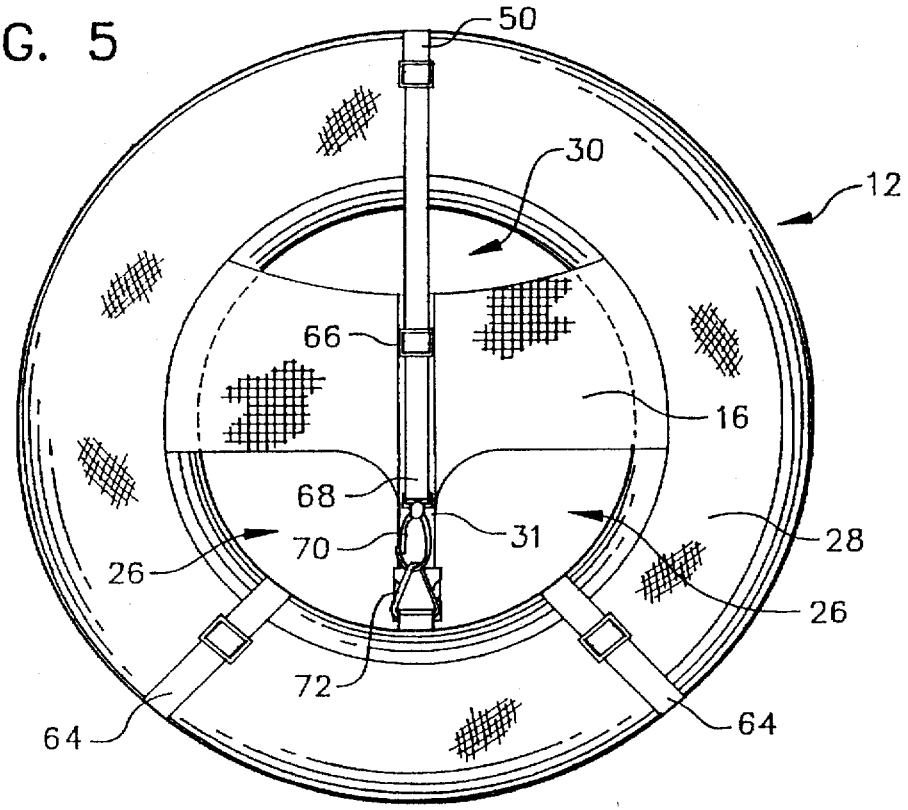
FIG. 5 is a bottom plan view of the mounting apparatus for the shelter of FIG. 1.
Figure 6:
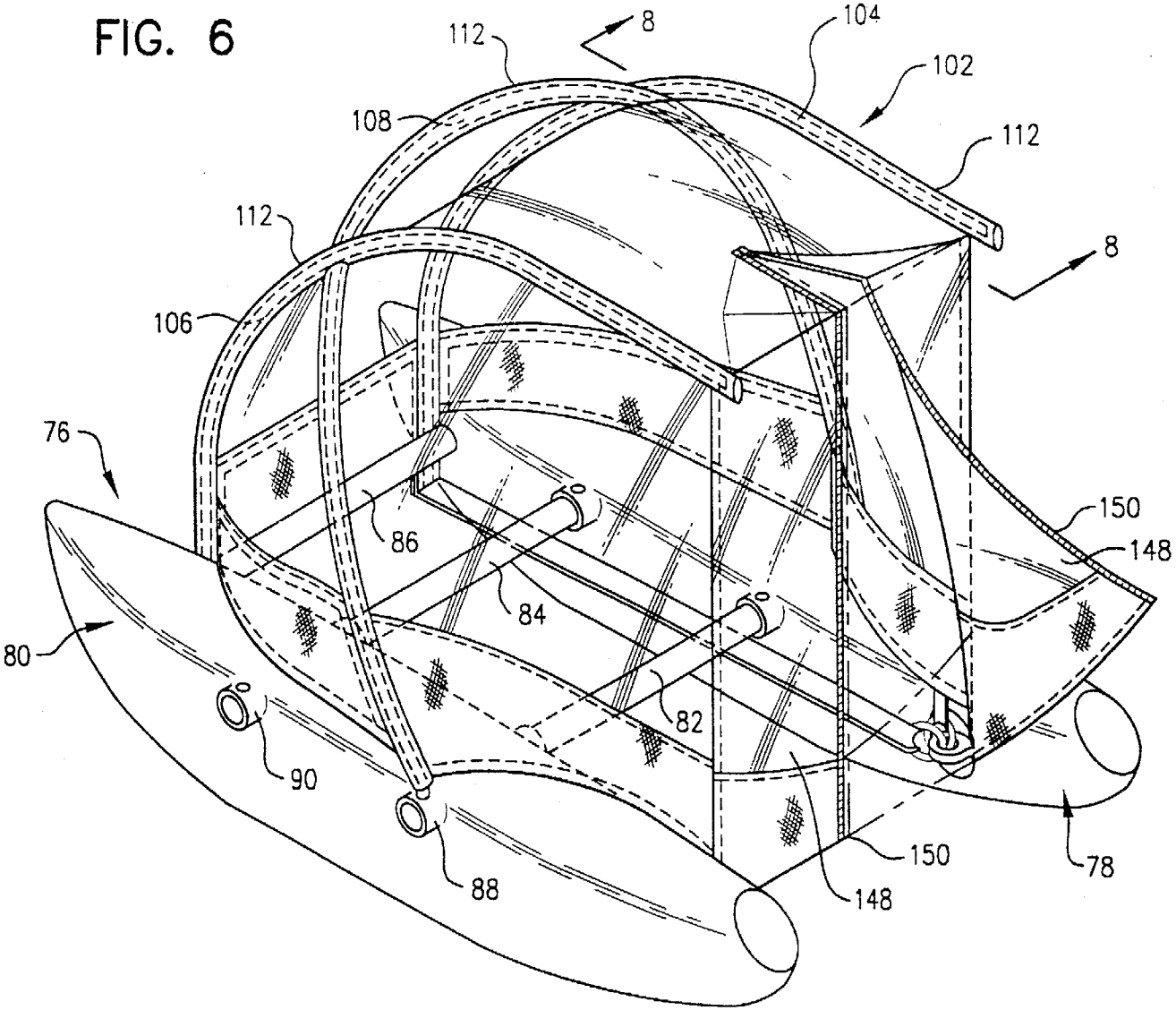
FIG. 6 is an isometric projection of an alternative embodiment of the present invention used in conjunction with a pontoon kick boat.

In a donut-shaped float tube, the user 18 sits on the seat 16, inserting the legs 24 through leg openings 26 formed in the seat 16. A seat support strap 31 holds the front of the seat 16 taut, as is shown in FIG. 5. The seat 16 is attached to the tube 12 near the bottom surface 28, and is positioned inside the central opening 30 of the tube 12. The legs 24 extend laterally outward beneath the bottom surface 28 of the tube 12 and are used to move the tube by paddling or kicking. U-shaped tubes and kick boats are similarly designed with the user positioned on a seat that is formed from nylon or other materials and includes openings for legs to extend for paddling or kicking.

The shelter 10 is comprised of a covering 32 formed from clear vinyl top window panels 34, waterproof lower front, rear, and side panels **36*a*, 36*b*, and 36*c*, respectively, a rear window panel 37, and front window panel flaps 39. These panels 34, 36, 37, and 39 may be tinted, clear, or have a camouflage design scheme as needed for the application. The panels 34, 37 and 39 should be of sufficient thickness to withstand repeated folding and outdoor use. They are sewn together at seams 41**.

The covering 32 is sized and shaped to be received over the top surface 22 of the float tube 12. It is cut and sewn together to have a somewhat dome-shaped configuration when assembled. A flexible longitudinal rod 38 and a flexible transverse rod 40 cooperate to hold the shape of the covering. These rods 38,40 are ideally formed of fiberglass, aluminum, or other resilient yet rigid material, and may include a centrally disposed shock-cord to enable breaking down and folding of the rods 38,40 into a disassembled configuration for storage or portage, such as are commonly used in small tents and which are readily commercially available.

The longitudinal rod 38 is slidably disposed within a central sheath 42 formed on the outside of the covering 32. Ripstop nylon or other durable material may be used to construct the sheath 42. The sheath 42 terminates in a forward sleeve 44 at one end and an opening 46 at the other end. A rearward sleeve 48 is formed on a strap 50 depending from the lower rear panel **36*b* near the opening 46 on the sheath 42. The sleeves 44,48 are sized and shaped to receive the forward end 52 and rearward end 54 of the longitudinal rod 38**, respectively, and to hold it in place.

The transverse rod 40 is positioned against the inside of the covering 32, and has its ends 56 received in pockets 58 formed on the inside of the two side panels **36*c*. These pockets 58 project below the side panels 36*c* a sufficient distance to be received within the handles 14 on the float tube 12 when the transverse rod 40 is inserted therein. An internal sheath similar to sheath 42 may be used inside the covering 32 through which to hold the transverse rod 40 in place, however this is optional and is not shown in this embodiment. To stabilize the covering 32 on the tube 12, side straps 53 are attached to the lower rear panels 36*b* or 36*c* to depend downward. Snap hooks 55, or other suitable attachment devices, are attached to the side straps 53 and hook on to the tube handles 14. The back support 20 urges the straps away from the handles 14**, thus keeping the hooks in positive engagement with the handles.

To provide further security in the attachment of the shelter 10 to the tube 12, a pair of snap hooks 59 are attached to straps 60 depending from the interior of the lower side panels 36. Stretchable cord may be used in place of the straps. The snap hooks 59 attach to loops 62 that are held in place on the tube 12 by tube straps 64.

The rear strap 50 is of sufficient length to stretch underneath the bottom surface 28 of the tube 12 and end near the seat support strap 31. A buckle 66 provides adjustment in the serviceable length of the rear strap 50. At the terminal end 68 of the strap 50 is a hook 70 to which is attached a flexible filament 72. This flexible filament 72 in turn is attached around the seat support strap 31.

This rear strap 50 not only secures the shelter 10 to the tube 12, it also transfers the force of the user's weight from the seat to the longitudinal rod 38, thus pulling the entire shelter 10 into a very taut condition and urging the longitudinal rod 38 up away from the head of the user 18.

The front flaps 39 are held together by a zipper 74 running substantially the entire vertical height of the flaps 39. This provides protection to the user 18 from wind, cold, and moisture. When unzipped, the flaps 39 may be secured against the side panels 36*c* by suitable fasteners, such as hook and loop, snaps, etc.

The shelter 10 may be stored and transported in a disassembled condition, i.e., detached from the tube 12 with the rods 38,40 removed and folded up. The disassembled components may be stored in a back pack or their own carrying bag (not shown).

To assemble, the covering 32 is unfolded and spread out over the tube 12. The side straps 53 are hooked to the tube handles 14, and the rear strap 50 is placed under the bottom surface 28 of the tube 12 and attached to the seat support strap 31. The rods 38, 40 are then assembled and inserted into their respective pockets. The longitudinal rod 38 is first inserted into the sheath 42 through an opening 76 in the forward sleeve 44 until the rearward end 54 projects out the opening 46 and into the rearward sleeve 48. The forward sleeve 44 is then secured over the forward end of the rod 38. The transverse rod 40 is bent and inserted into the side pockets 58. The side pockets 58 are then inserted between the handles 14 and the tube 12. The snap hooks 59 are then 12, and the snap hooks 59 are attached to the loops 62.

The user 18 can either place the tube in water of sufficient depth to permit stepping into the central opening 30 and through the leg openings 26. Alternatively, the user may step into the leg openings on land, and then walk into the water, although this method is a bit more cumbersome. With the zipper 74 holding the front flaps 39 closed, the user 18 can still see through the clear window panels on the front, side, and rear.

To provide ventilation and access to the outside, the front panels are unzipped and folded against the side panels. Optional hook and loop fasteners or other commercially available fasteners may be used to secure the front panels in the open configuration. The user may then place the arms outside for fishing, taking pictures, shooting, etc.

Disassembly and storage are accomplished by reversing the foregoing steps. While a preferred embodiment of the invention has been illustrated and described, it is to be understood that various changes may be made therein without departing from the spirit and scope of the invention. For example, in float tubes and kick boats that do not have handles 14 or back supports 20, suitable straps can be placed around the tube 12 and hooks on the covering 12 can be attached thereto.

Furthermore, the position and location of the flexible rods 38,40 may be changed without affecting the features of providing shelter and concealment of the occupant. Additional accessories may also be added, such as cords and pockets suspended inside the covering 32 for holding or storing items such as flashlights, fans, tools, maps, etc.

Figure 7:
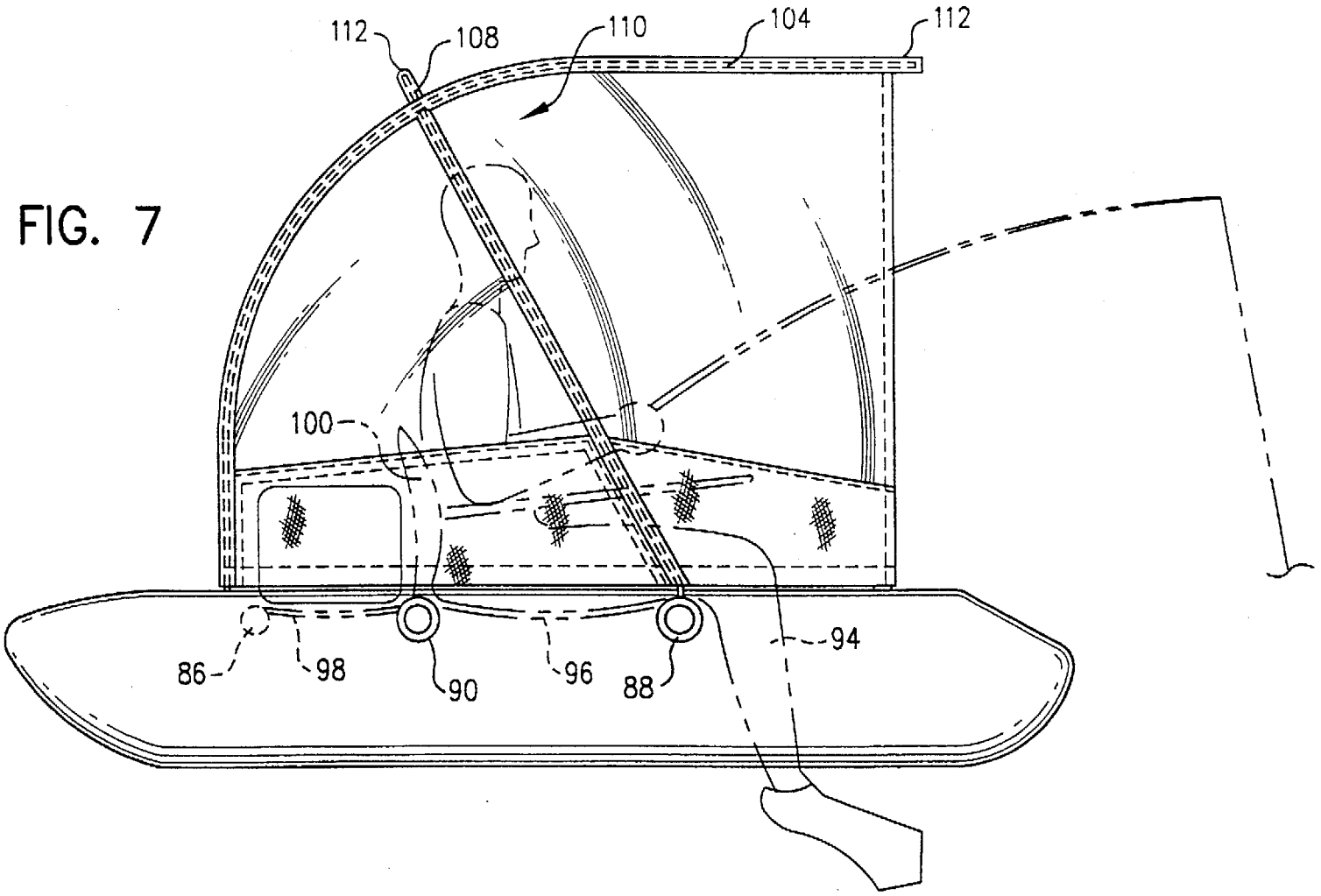
FIG. 7 is a side plan view of the embodiment of FIG. 6 formed in accordance with the present invention.

FIGS. 6 through 11 illustrate an alternative embodiment of the invention as used in conjunction with a pontoon kick boat 76. As shown therein, the kick boat 76 includes first and second pontoons 78 and 80 held in rigid parallel relationship by a forward transverse rod 82, a central transverse rod 84, and a rear transverse rod 86. In the configuration show, the forward and central transverse rods 84 and 86 project through the pontoons 78 and 80 to a short distance beyond the outside of the pontoons 78 and 80 to form short cylindrical projections 88 and 90. A seat 92 for a user 94 may be attached to the forward and central transverse rods 82 and 84 as shown in FIG. 7, as well as a second seat or cargo support 94 suspended between the central and rear transverse rods 84 and 86 for cargo 99. An optional seat back 100 is also shown.

The alternative embodiment of the shelter 102 is comprised of first and second longitudinal rods 104 and 106 affixed to the first and second pontoons 78 and 80, respectively, a transverse rod 108 attached to the first and second pontoons 78 and 80, and a covering 110 attached to the longitudinal rods 104 and 106, and the transverse rod 108.

The covering 110 of this embodiment is constructed in the same manner as the covering 32 of the first embodiment described in conjunction with FIGS. 1–5. In this alternative embodiment, the covering 110 is held in position by the first and second longitudinal rods 104 and 106 and the transverse rod 108, which are ideally formed of the same materials as the rods 38 and 40 described above. The rods 104, 106, and 108 are held to the covering 110 through slidable engagement with sheaths 112 in the same manner as described above in the first embodiment.

Figure 8:
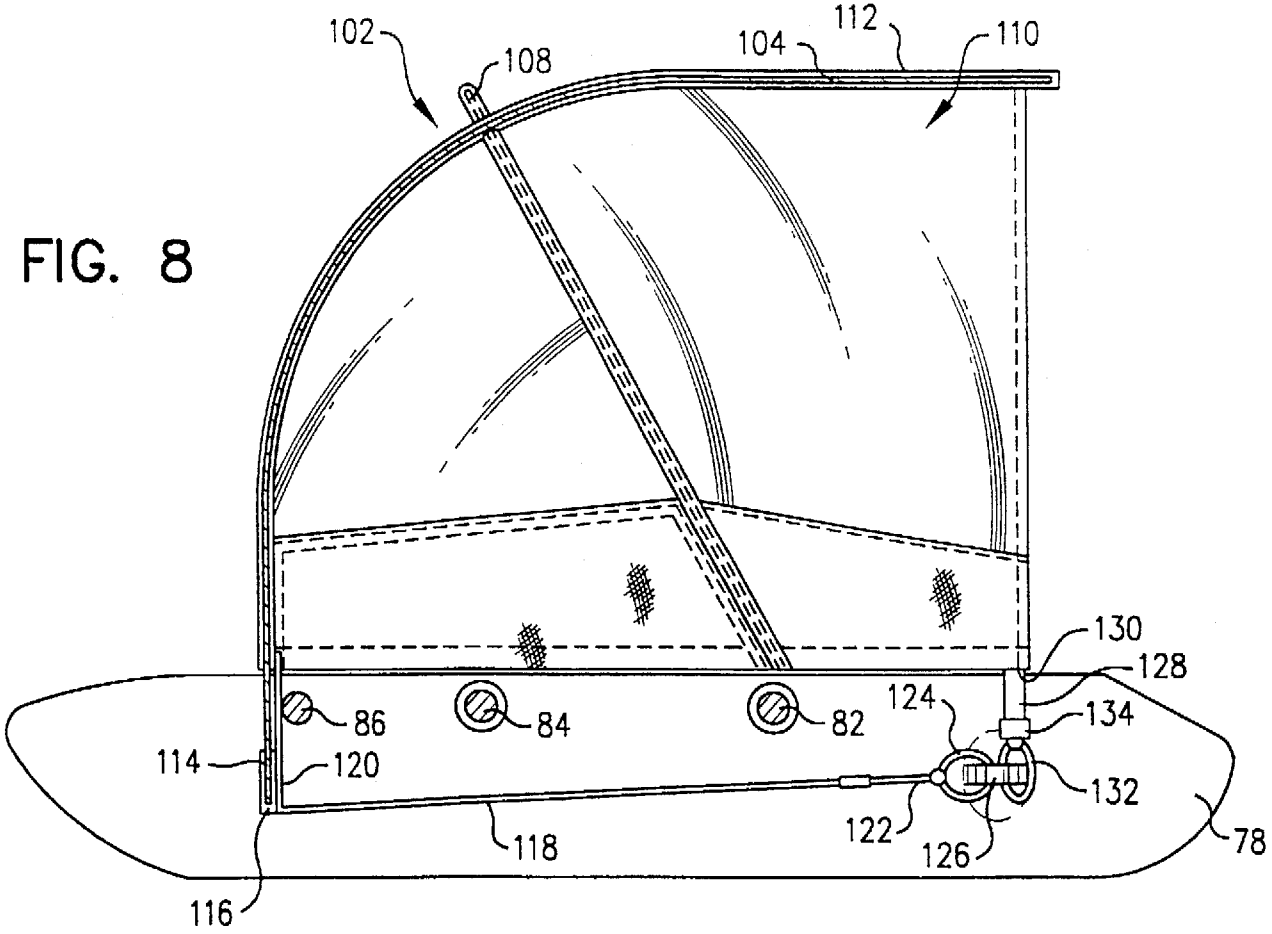
FIG. 8 is a cross-sectional view of the embodiment of FIG. 6 formed in accordance with the present invention taken along lines 8—8.

Referring next to FIG. 8, the rearward ends 114 of the longitudinal rods 104 and 106 are received in the reinforced sleeves 116 attached to the outside at the rear of the lower portion of the covering 110. A strap 118 has one end 120 attached to the inside lower portion at the rear of the covering 110 opposite each reinforced sleeve 116, preferably by stitching. The other end 112 of each strap 118 has a ring (or a hook may be used) 124 affixed thereto for tethering to a structural member 126 formed integrally with the pontoon 78. However, the structural member 126 may be separately tethered to the pontoon 78 or straps around inflatable-type pontoons may be used as a fixed tethering point. Also, the strap 118 may be formed of rigid or flexible material. However, the strap 118 is ideally formed of flexible non-elastic material, ideally a nylon belt, to maintain tension on the covering 110. It may also be formed of flexible filament that is adjustable in length, such as with a buckle. The strap 118 is positioned below the transverse rods 82, 84, and 86.

A second strap 128 has one end 130 attached at the bottom of each side at the front of the covering 110, as shown in FIG. 8, preferably by stitching, to depend downward towards the pontoons 78 and 80. The second strap 128 is formed in the same manner and of the same material as the first strap 128, with a ring 132 affixed at the free end 134 for tethering to the same structural member 126 or alternative tethering point as the first strap 118.

When the straps 118 and 128 are installed as described above, tension is maintained on the front and rear of the covering 110 to hold it in position on the kick boat 76. In addition, the tension exerted by the flexible rods 104, 106, and 108, in the sheaths 112 maintains the shape of the covering independent of the straps 118 and 128.

Figure 9:
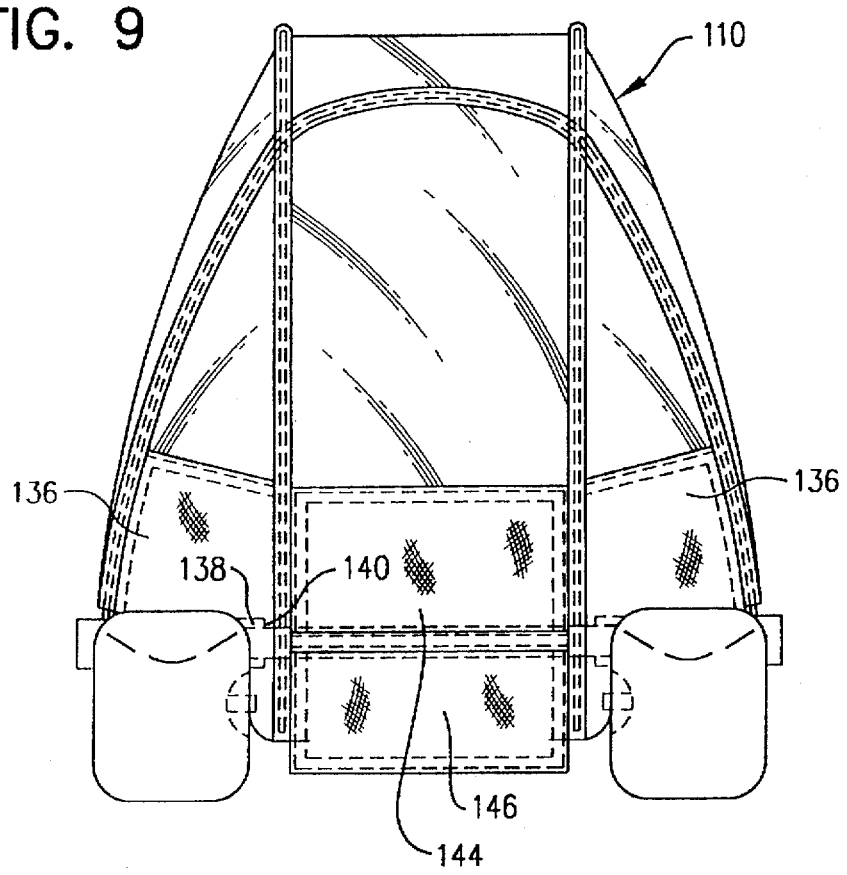
FIG. 9 is a rear view of the embodiment of FIG. 6 formed in accordance with the present invention.
Figure 10:
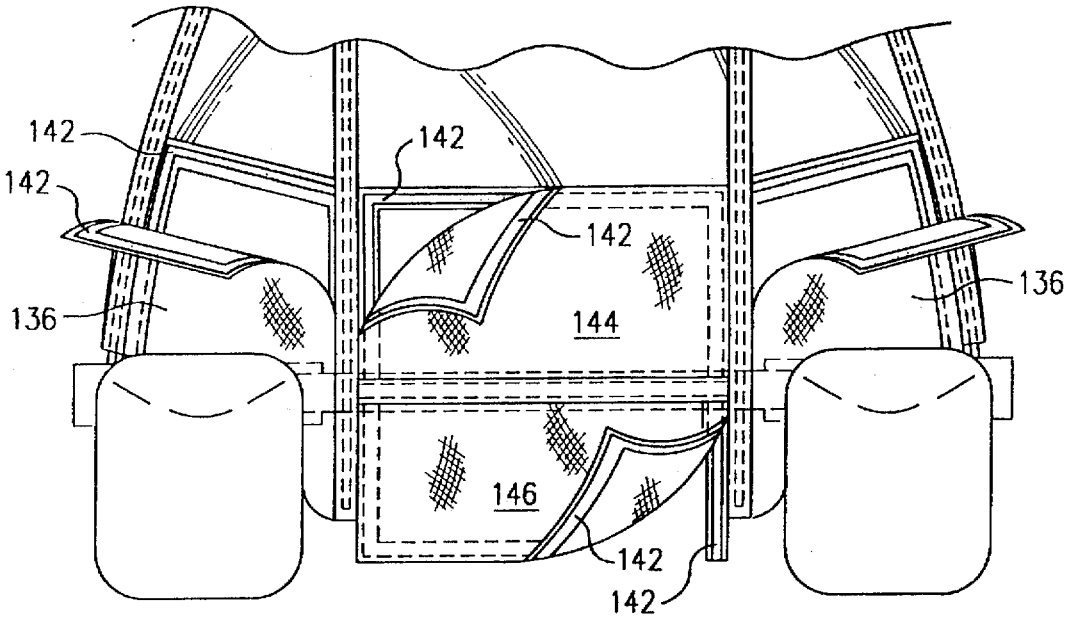
FIG. 10 is an enlarged rear view of a portion of the embodiment of FIG. 9 illustrating the flap configurations.

FIGS. 9 and 10 show the rear of the covering 110, which is ideally formed of transparent, flexible material on the top portion as described above in connection with the first embodiment. The lower portion of the covering 110 is formed of opaque material, again as described above. In the embodiment shown in FIGS. 9 and 10, the lower portion of the covering includes rear quarter panels 136 that have their lower sides 138 sewn to the seam 140 to permit the panels 136 to fold down. Hook-and-loop fasteners 142 are sown holding the rear quarter panels in the closed position in FIG. 9.

Similarly, an upper rear panel 144 and a lower rear panel 146 are formed on the covering 110, which can fold down to permit access to the rear of the covered kick boat 76 and enhance ventilation.

Figure 11:
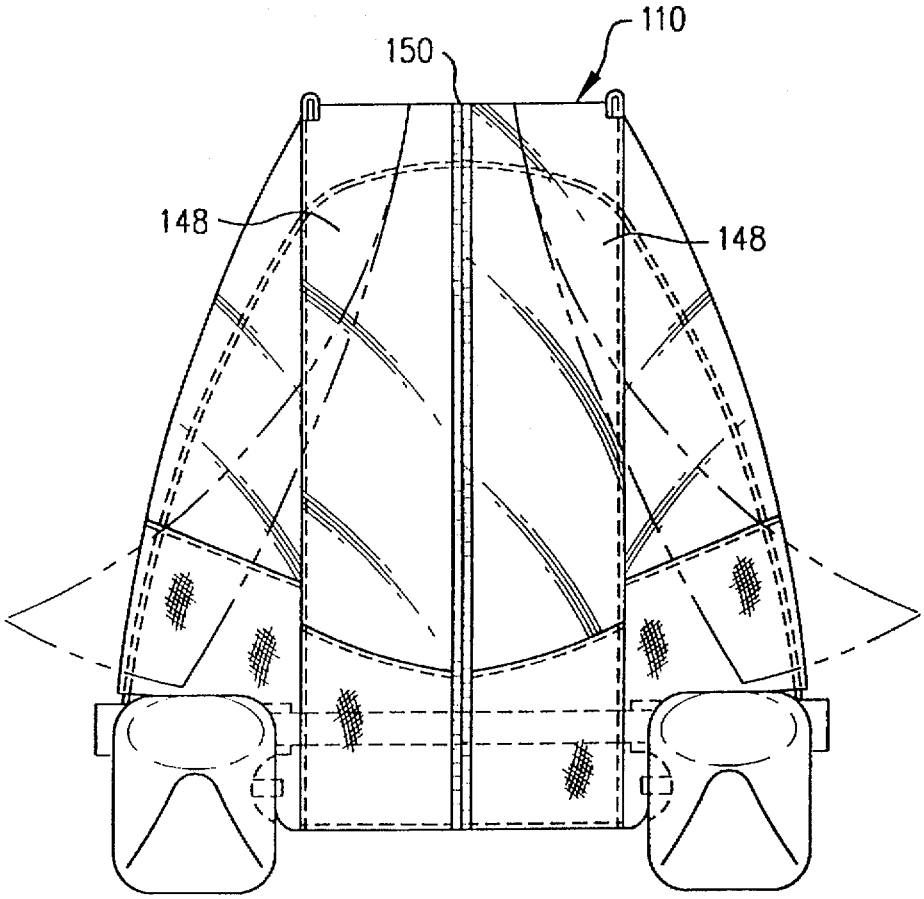
FIG. 11 is a front view of the embodiment of FIG. 6 illustrating in phantom the opening of the front flaps.

In FIG. 11, the front of the covering 110 is shown having two forward flaps 148 that are held in a closed position by a zipper 150. Ideally, the zipper 150 extends to the top of the covering 110 to facilitate access from above or the side of the kick boat 76. As sown in phantom, the forward flaps 148 may be folded back when unzipped. Hook-and-loop fasteners or other suitable means may be used to hold the flaps in the open position. More particularly, such hook-and-loop fasteners may be attached to the outside of the forward flaps 148 and the exterior of the covering 110 rearward of the flaps such that the flaps 148 may be attached to the exterior of the covering in a folded-back position. In this configuration, access to the exterior of the covering is facilitated for fishing, hunting, and photography. Ideally, the forward flaps 148 and the lower rear panel 144 are sized and shaped to extend downward below the transverse rods 84,86, and 88, and extend to adjacent the pontoons 78 and 80 to provide as much protection from the wind and the elements as possible. In kick boats that do not have all three transverse rods 84,86, and 88, or cylindrical projections 88 and 90, straps similar to side straps 53 or rear strap 50 described above may be used. Such straps would be fastened around the pontoons 78 and 80. A cylindrical cap affixed to the straps may be used to support optional transverse rods or to support the flexible rods.

To facilitate the use of oars, the panels 136 and 142 may be formed as flaps by having the lower edges 152 sewn in place and the side edges 154 and top edges held in place by hook and loop fasteners. When the panels 136 and 142 are folded down, oars may be inserted there through.

Other alternative embodiments may be formed in accordance with the present invention without departing from the spirit thereof. Thus, the invention is to be limited only by the scope of the appended claims. Consequently, the invention is to be limited only by the scope of the appended claims.

The embodiments of the invention in which an exclusive property or privilege is claimed are defined as follows:

1. A shelter for single-user watercraft, such as float tubes, kick boats, and the like, the shelter comprising:

a covering formed of flexible material and having an enclosed top and open bottom;

shape retaining means for holding said covering in a taut condition, said shape retaining means further comprising at least one transverse member and at least one longitudinal member, each of said shape retaining means having an elongate configuration with a first end and a second end, and each of said shape retaining means being formed of resilient material;

means for engaging said shape retaining means with said covering such that said second end of said at least one longitudinal member is positioned at least adjacent said top of said covering;

means for attaching said covering to the watercraft; and means for tensioning said covering to urge said covering above the watercraft to thereby urge said at least one longitudinal member away from the watercraft, said tensioning means comprising at least one flexible filament having one end functionally attached to said first end of said at least one longitudinal member and the other end attached to the watercraft.

2. The shelter of claim 1, wherein said tensioning means further comprises means for adjusting the applied length of said flexible filament to thereby adjust the tension exerted on said at least one longitudinal member.

3. A shelter for single-user watercraft, such as float tubes, kick boats, and the like, the shelter comprising:

a taut covering having an enclosed top and an open bottom sized and shaped to be received on the watercraft, said taut covering formed of flexible material and held in said taut condition by shape retaining means engaged therewith;

said shape retaining means comprising at least one longitudinal member and one transverse member, each of said shape retaining means having an elongate configuration with a first end and a second end and formed of resilient material;

said at least one longitudinal member having said second end positioned at least adjacent to said top of said covering, and said first end engaged with said bottom of said covering;

means for removably attaching said taut covering to the watercraft; and means for urging said second end of said at least one longitudinal member away from the watercraft, said urging means comprising at least one flexible filament having one end attached to said bottom of said covering where said first end of said at least one longitudinal member is attached to said bottom of said covering, and the other end attached to the watercraft, whereby said at least one longitudinal member is braced against the watercraft to thereby urge said second end of said at least one longitudinal member away from the watercraft.

4. The shelter of claim 3, wherein said urging means further comprises means for adjusting the applied length of said at least one flexible filament to thereby adjust the tension exerted on said at least one longitudinal member.

5. The shelter of claim 4, wherein said at least one flexible filament is formed of elastic material.

* * * * *